US007059347B2

(12) United States Patent
Schwartzman

(10) Patent No.: US 7,059,347 B2
(45) Date of Patent: Jun. 13, 2006

(54) AIR BLEED APPARATUS FOR A BURNER UNIT

(75) Inventor: Alexander Schwartzman, Richmond (CA)

(73) Assignee: Teleflex Canada Incorporated, Richmond (CA)

( * ) Notice: Subject to any disclaimer, the term of this patent is extended or adjusted under 35 U.S.C. 154(b) by 0 days.

(21) Appl. No.: 10/997,998

(22) Filed: Nov. 29, 2004

(65) Prior Publication Data

US 2005/0089810 A1 Apr. 28, 2005

Related U.S. Application Data

(62) Division of application No. 10/349,940, filed on Jan. 24, 2003, now Pat. No. 6,857,448.

(51) Int. Cl.
*F16K 11/04* (2006.01)

(52) U.S. Cl. ..... 137/595; 17/625.18

(58) Field of Classification Search ..... 137/594, 137/595, 625.18, 637.2, 637.3
See application file for complete search history.

(56) References Cited

U.S. PATENT DOCUMENTS

| | | | | |
|---|---|---|---|---|
| 1,515,673 | A * | 11/1924 | Geissinger | 137/595 |
| 1,529,015 | A | 3/1925 | Dodge | |
| 1,598,866 | A | 9/1926 | Lovell | |
| 1,961,083 | A * | 5/1934 | Sherman et al. | 137/595 |
| 2,040,231 | A * | 5/1936 | Woolley | 137/595 |
| 2,870,764 | A | 1/1959 | Carlson | |
| 3,071,936 | A | 1/1963 | Irwin | |
| 3,487,435 | A | 12/1969 | Sheardown | |
| 3,577,877 | A | 5/1971 | Warne et al. | |
| 3,847,537 | A | 11/1974 | Velie | |
| 3,905,729 | A | 9/1975 | Bauer | |
| 3,947,218 | A | 3/1976 | Landis | |
| 4,149,842 | A | 4/1979 | Benjamin | |
| 4,223,692 | A | 9/1980 | Perry | |
| 4,259,985 | A | 4/1981 | Bergmann | |
| 4,340,362 | A | 7/1982 | Chalupsky et al. | |
| 4,431,382 | A | 2/1984 | Edman et al. | |
| 4,774,846 | A | 10/1988 | Taubenmann | |
| 5,080,580 | A | 1/1992 | Clapp | |
| 5,527,180 | A | 6/1996 | Robinson et al. | |
| 5,927,961 | A | 7/1999 | Robinson et al. | |
| 6,450,801 | B1 | 9/2002 | Winechenko et al. | |

FOREIGN PATENT DOCUMENTS

| | | |
|---|---|---|
| EP | 0 328 418 | 8/1989 |

* cited by examiner

*Primary Examiner*—John Rivell
(74) *Attorney, Agent, or Firm*—Norman M. Cameron

(57) ABSTRACT

A control apparatus simultaneously controls flow rates of a first fluid and a second fluid. The apparatus comprises a control valve for controlling the flow rate of the first fluid and a bleed device for bleeding the second fluid. The control valve is operatively connected to the bleed device, whereby, as the control valve is opened progressively greater amounts to increase flow of the first fluid, the bleed device is progressively closed to decrease bleeding of the second fluid, and, as the control valve is closed progressively greater amounts to decrease flow of the first fluid, the bleed device is progressively opened to increase bleeding of the second fluid. The control apparatus may be installed in a burner unit of the type having a compressor supplying pressurized air to the burner and a fuel pump supplying fuel to the burner. The control valve controls the fuel and the bleed device increases bleeding of the air as the control valve closes.

5 Claims, 10 Drawing Sheets

AIR BLEED APPARATUS FOR A BURNER UNIT

RELATED APPLICATION

This is a divisional application of U.S. patent application Ser. No. 10/349,940 filed Jan. 24, 2003 now U.S. Pat. No. 6,857,448.

BACKGROUND OF THE INVENTION

This invention relates to burners and heaters and stoves including such burners and, in particular, to multifuel burners, stoves and burners, such as multifuel stoves utilized for cooking during military field operations.

Earlier U.S. Pat. No. 6,450,801 assigned to Teleflex (Canada) Limited discloses a much improved liquid fuel stove apparatus compared with earlier equipment of this nature utilized for such purposes as cooking during military field operations. Such portable stoves are used in range ovens, steam tables, tray ration heaters, field sanitation equipment and stock pot heating racks. These appliances perform functions like roasting, grilling, broiling, frying, heating water and other liquids and baking. The stoves may operate under difficult field conditions and therefore must be reliable in operation and be capable of performing to a high level in order to meet the demands of the users.

The unit described above has a fuel delivery block which combines a series of different functions such as:

atomizing the fuel by mixing it with the compressed air;

opening and shutting off the fuel passages in accordance with operational requirements;

redirecting compressed air for atomizing the fuel or refueling;

accommodating the ignitor for starting the burning process;

supporting the flame sensor which maintains safe operations;

regulating the fuel flow from low to high, infinitely, relative to the knob position; and maintaining a correct air/fuel ratio throughout the complete range of heat output for efficient and safe combustion.

In one embodiment, for example, the heater had a flow rate adjustable from 1.1 gallons per hour to 2.6 gallons per hour. For some applications, such as slow simmering, the minimum flow rate provided is too high.

In earlier multifuel burner units of the type described above, the fuel flow rate is controlled by a needle valve having an orifice and a cone-shaped needle on the end of a threaded stem. When the needle valve stem is turning on the thread, rotational motion transfers into linear displacement of the needle tip inside the orifice. It changes the opening area and, correspondingly, the fuel rate. The needle valve stem is attached to the knob by a collet which grasps the stem shank when the collet nut is tightened. Rotation of the knob is limited by two positive stops pressed into the body of the fuel delivery block and has an approximately 300° angle of rotation from high to low knob position. For example, when the knob is placed in the low position and the collet nut is released, it is possible to adjust the minimum fuel flow rate by turning the needle valve stem through the opening in the knob. Then tightening the knob, the fuel delivery block is adjusted to the required fuel flow setting (high flow, as well as the in between fuel range are defined by the profile of the needle). The knob also has two plastic tabs which are inserted into two slots of the inner ring of the potentiometer. The potentiometer is part of the power circuit of the compressor. When the knob turns, it also turns the inner ring of the potentiometer and changes its resistance. It activates the PWM (pulse width modulation) circuit and, as a result, compressor voltage changes. The stove electronic controller is programmed in such a way that, for each position of the potentiometer, it provides a certain voltage to the compressor.

In theory it would seem possible to reduce the output of the heater further utilizing the needle valve and the potentiometer. However in practice the PWM control circuit cannot be used to reduce the air flow rate further because the compressed air pulsates at low compressor speeds, causing emissions to go up considerably due to bad combustion. In the embodiment described above, for example, the low-end output of the compressor is 5 psi, while the high-end is 9 psi. Achieving a lower output would require a compressor output of approximately 2 psi. The earlier embodiment is not capable of such a low compressor output for the reasons discussed above.

Accordingly it is an object of the invention to provide an improved burner, heater and stove of the type described above but having improved simmering capabilities.

It is also an object of the invention to provide improved burners, heaters and stoves of the type described above, which are capable of operating at reduced fuel flow rates while maintaining air flow rates at a level for proper combustion.

SUMMARY OF THE INVENTION

According to one aspect of the invention there is provided a control apparatus for simultaneously controlling flow rates of a first fluid and a second fluid. The apparatus comprises a control valve for controlling the flow rate of the first fluid and a bleed device for bleeding the second fluid. The control valve is operatively connected to the bleed device whereby, as the control valve is opened progressively greater amounts to increase flow of the first fluid, the bleed device is progressively closed to decrease bleeding of the second fluid, and, as the control valve is closed progressively greater amounts to decrease flow of the first fluid, the bleed device is progressively opened to increase bleeding of the second fluid.

The first fluid may be a liquid and the second fluid a gas, the control valve being a needle valve. The needle valve may be operatively connected to the bleed device by a control member. The apparatus may include a valve body having a cavity therein and a valve member releasably connected to the control member and rotatably received within the cavity. The bleed device is then on the valve member, the cavity having a female threaded portion which threadedly receives a male threaded portion of the valve member, whereby rotation of the control member moves the valve member axially within the cavity to open or close the bleed device. The needle valve includes a shank having a valve tip, the shank being received by the valve member. The shank is releasably connected to the control member, whereby, when the control member is connected to the valve member and to the shank, rotation of the control member in a first rotational direction moves the valve tip toward the valve seat to close the needle valve and rotation of the control member in a second rotational direction, opposite the first rotational direction, moves the valve tip away from the valve seat to open the needle valve.

The body may have a passageway for the gas which intersects the cavity, the valve member having a portion which selectively blocks the passageway or opens the passageway as the control member is rotated.

In one example the valve member has an opening adjacent to the portion thereof which progressively aligns with the passageway as the needle valve is closed, thereby increasing bleeding of the gas.

According to another aspect of the invention, there is provided a heater comprising a burner, a compressor operatively connected to the burner for supplying compressed air to the burner, a fuel supply connected to the burner for supplying fuel to the burner and an apparatus for simultaneously controlling flow rates of the fuel and the compressed air to the burner. The apparatus includes a control valve for controlling the flow rate of the fuel and a bleed device for bleeding the air. The control valve is operatively connected to the bleed device whereby, as the control valve is opened progressively greater amounts to increase flow of the fuel, the bleed device is progressively closed to decrease bleeding of the air, and, as the control valve is closed progressively greater amounts to decrease flow of the fuel, the bleed device is progressively opened to increase bleeding of the air.

The invention offers significant advantages compared to earlier devices of this type. It permits a burner unit to operate at a low combustion rate while maintaining even, clean combustion. This is because the compressor can operate within an optimal speed range and excess air is simply bled off from the output to the intake of the compressor. Accordingly the burner unit is considerably quietened at simmer. This is accomplished without radical redesign of the unit. Also, the construction is simple and reliable. Furthermore, the invention is also applicable to other devices besides burners, where it may be desirable to bleed off one fluid as flow of another fluid is decreased.

BRIEF DESCRIPTION OF THE DRAWINGS

In drawings which illustrate embodiments of the invention.

DETAILED DESCRIPTIONS OF THE PREFERRED EMBODIMENTS

Figure 1:
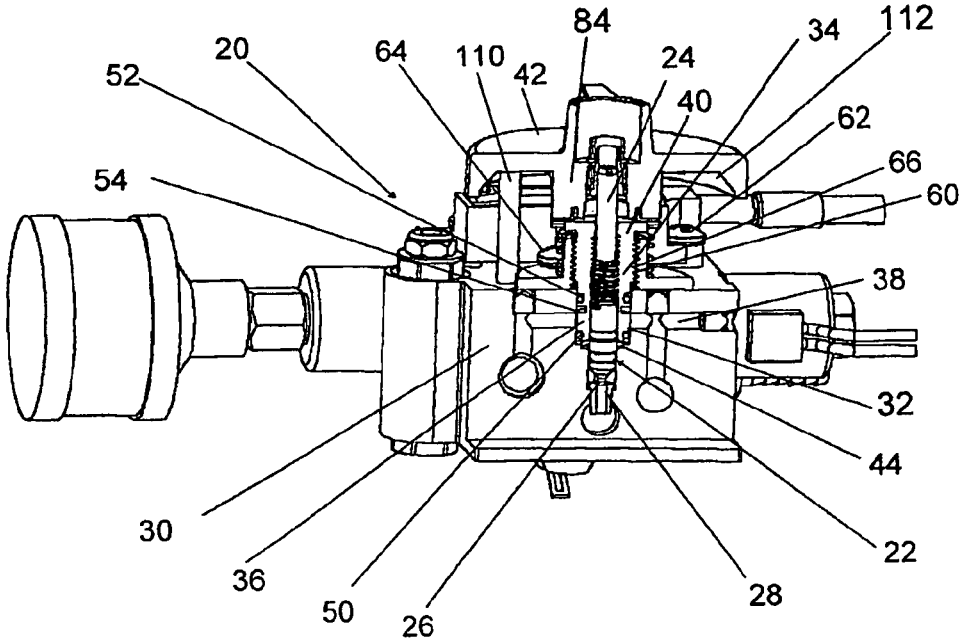
FIG. 1 is an isometric view, partly broken away, of an apparatus for controlling the flow of one fluid and bleeding another fluid, according to an embodiment of the invention.

Referring to the drawings, and first to FIG. 1, this shows a valve control apparatus 20 for simultaneously controlling flow rates of a first fluid, such as a liquid fuel, and a second fluid, such as air. The apparatus includes a control valve shown generally at 22 which, in this embodiment, is a needle valve including a shank 24, having a valve tip 26, and a valve seat 28. The apparatus also includes a valve body 30 having a cylindrical cavity 32 therein.

A valve member 34 is received in the cavity. The valve member is also cylindrical and has a portion 36 which closely fits the cavity. There is a passageway 38 for air in the body which intersects the cavity adjacent to the portion 36 of the valve member. In the position of the valve member shown, this portion blocks the passageway completely. The valve member has a first end 40 adjacent to a control member in the form of knob 42 in this embodiment. The valve body has a second end 44 which is opposite to the first end. There are seals between the valve member and the cavity in the body in the form of an O-ring 50 adjacent to the end 44 and a second O-ring 52 on the opposite side of the portion 36.

There is an annular opening or groove 54 adjacent to the portion 36 and located between the portion 36 and the O-ring 52. As explained in more detail below, this groove permits air to bleed through the passageway 38 when the valve member moves downwardly from the point of view of FIG. 1.

The body includes a collar 60 which is connected to the rest of the body by screws 62 and 64 in this embodiment. The collar has internal female threads 66 forming part of the cavity. It should be understood that in other embodiments the collar could be integrated with the rest of the body or the female threads could be in the rest of the body below the collar. In any case the female threads threadedly receive male threaded portion 70 of the valve body shown best in FIG. 2.

Figure 2:
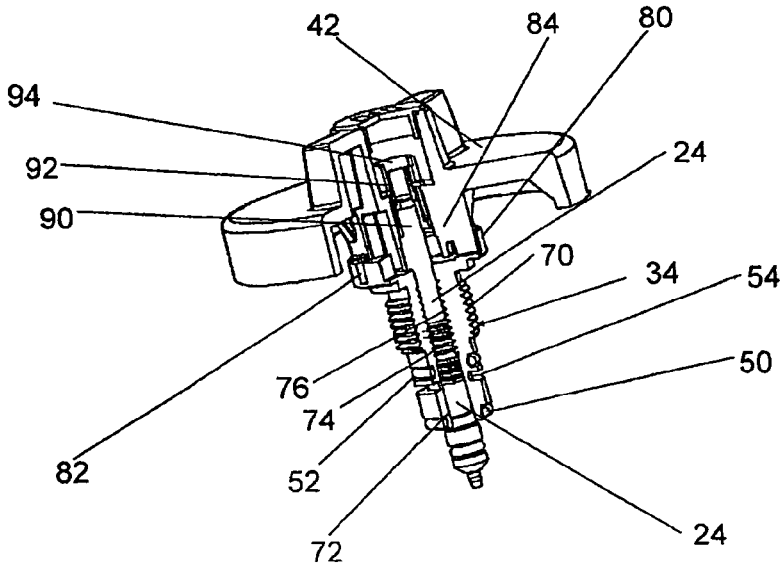
FIG. 2 is an isometric view, partly broken away, of the control knob and valve member thereof.

There is a bore 72 extending axially through the valve member 34, coaxially with the cavity 32. This is best shown in FIG. 2. The shank 24 is received within the bore and has a male threaded portion 74 threadedly received by threaded portion 76 of the bore.

Figure 3:
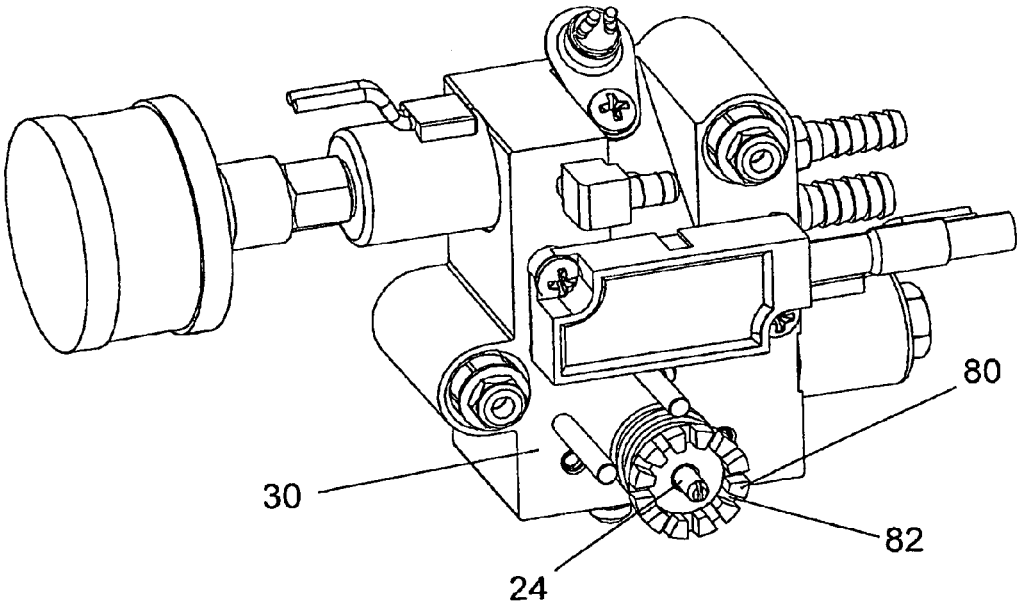
FIG. 3 is a plan view of the apparatus shown installed on a burner unit, with the control knob thereof removed.

The valve member has a collar 80 adjacent to its outer end 40. The collar has a plurality of circumferentially spaced-apart recesses or slots 82 shown best in FIG. 3. Knob 42 has a projection 84 shaped to selectively fit within one of the slots 82. Thus, when the knob is removed from the valve member, it can be replaced in any desired rotational position permitted by the slots 82. Alternatively, in another embodiment, the knob has a multi-sided socket, typically octagonal, and the collar has a complementary shape, again allowing the knob to be placed in a plurality of different positions relative to the valve member.

Figure 2A:
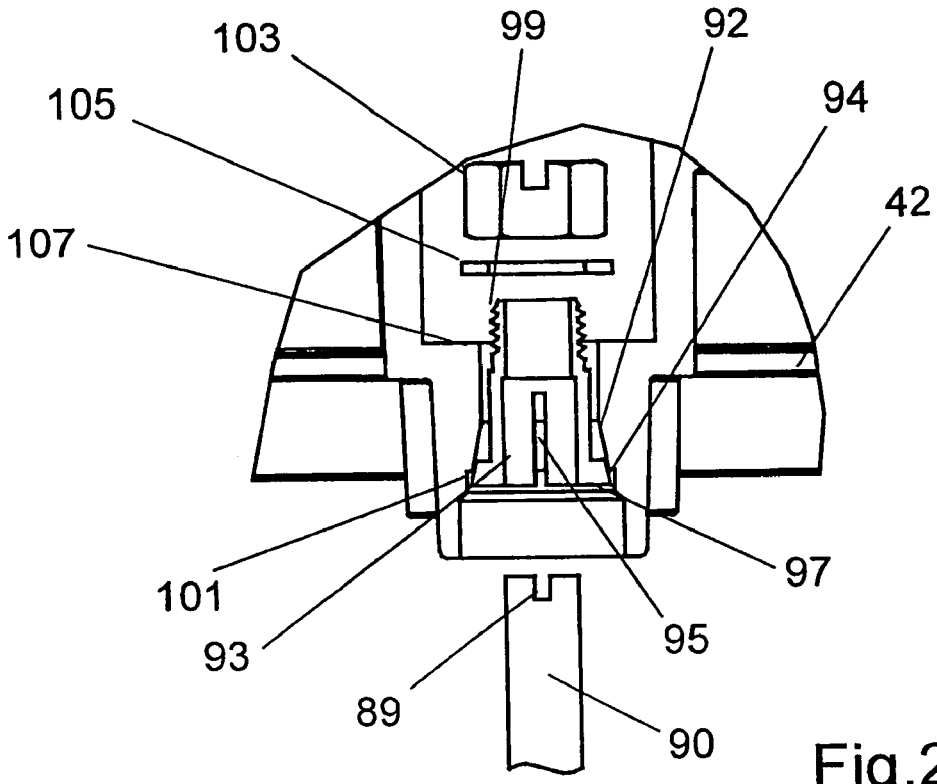
FIG. 2*a* is a fragmentary, exploded sectional view of the control knob and associated components.
Figure 2B:
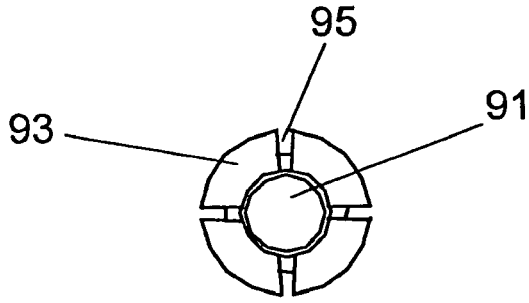
FIG. 2*b* is a bottom plan view of the collet thereof.

The shank has a tapered outer end 90 which can be tightly received within cylindrical opening 91 of collet 93 in the knob as shown in FIGS. 2*a* and 2*b*. There is a slot 89 at the outer end 90. The collet has four radially extending slots 95 at its bottom end and a threaded shank 99 in this example. The collet has a tapered outer surface 101 which contacts inner tapered surface 92 of bushing 94. A nut 103 threadedly engages the threaded shank 99 with washer 105 therebetween. The washer contacts annular surface 107 of the knob. It may be seen that by rotating the nut 103, the collet is tightened within the bushing 94 which, in turn, tightens the outer and 90 of the shank 24. Likewise it may be seen that, by loosening the nut, the outer end 90 of the shank 24 can be adjusted rotatably with respect to the collet and can be rotatably adjusted with respect to the bushing and the knob.

Figure 12:
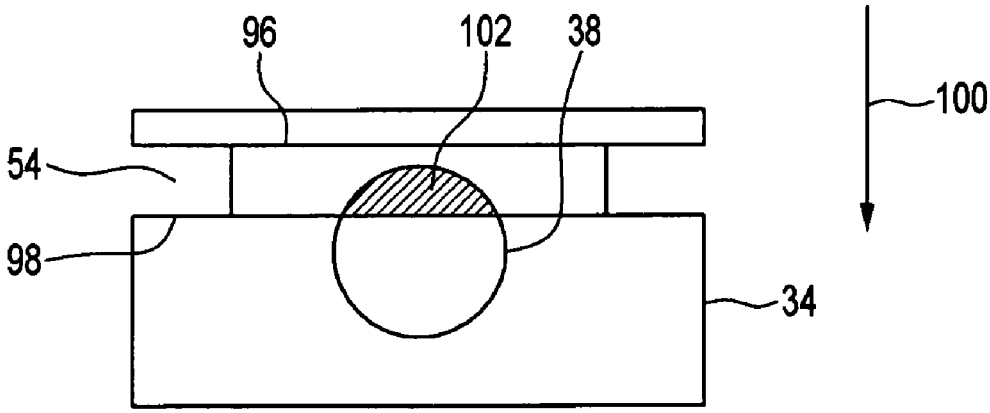
FIG. 12 is a simplified, diagrammatic view showing the groove on the valve member of FIG. 1 and the bleed passageway in the body thereof.

Referring to FIG. 12, the passageway 38 in this example is circular in shape. The opening or groove 54 on the valve member 34 is annular, having sides 96 and 98 which are parallel and spaced-apart axially along the member. Thus, when the valve member moves downwardly relative to the passageway, as indicated by arrow 100, the passageway is gradually opened in a nonlinear manner as the area identified by the shaded portion 102 increases.

Figure 11:
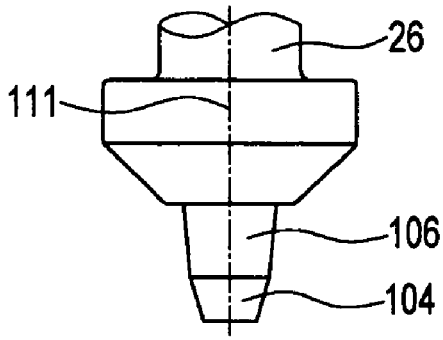
FIG. 11 is a fragmentary side view of the tip of the needle valve of the embodiment of FIG. 1.

Referring to FIG. 11, valve tip 26 of the needle valve includes an outer frusto-conical portion 104 and an inner frusto-conical portion 106. The outer portion is less acutely angled than the inner portion with respect to the longitudinal axis 111 of the shank. The shapes of the passageway, the groove 54 and the tip of the needle valve are selected so as to give correct proportions of air and fuel as the needle valve is closed.

Pin 110 extends outwardly from the body 30 toward the control knob 42 as seen in FIG. 1. The knob has a projection 112 positioned to contact the pin to limit rotation of the knob between desired low and high settings.

Figure 13:
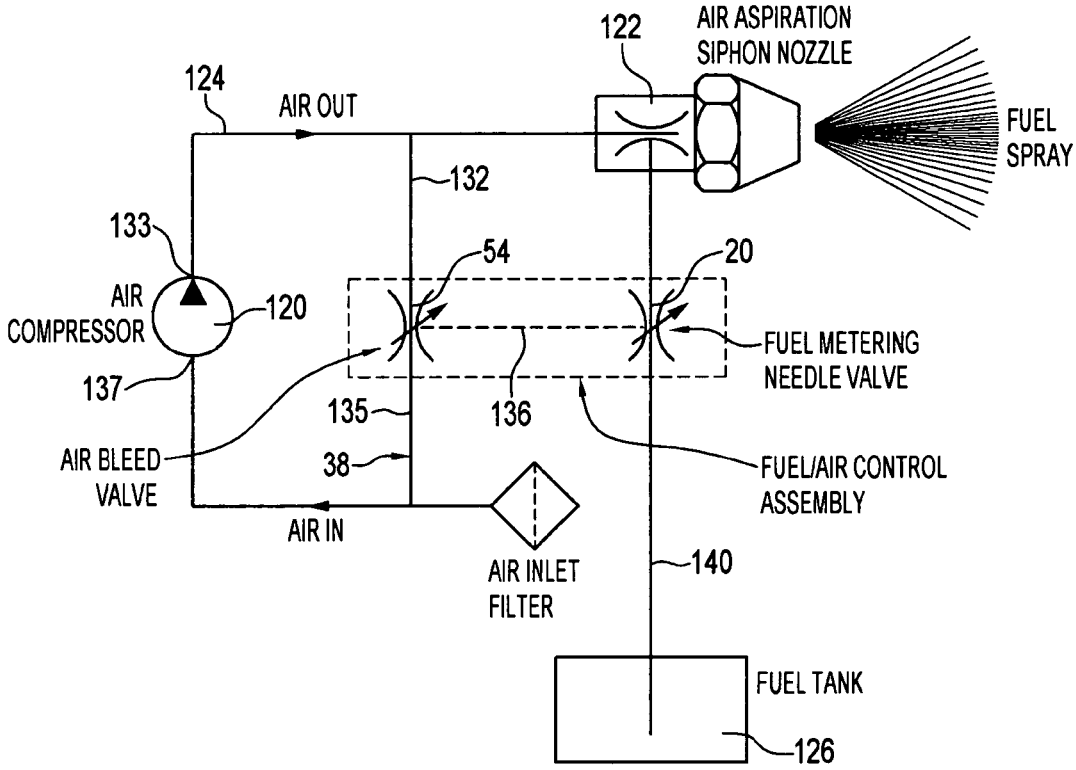
FIG. 13 is a schematic diagram of a burner apparatus incorporating the embodiment of FIG. 1.
Figure 14:
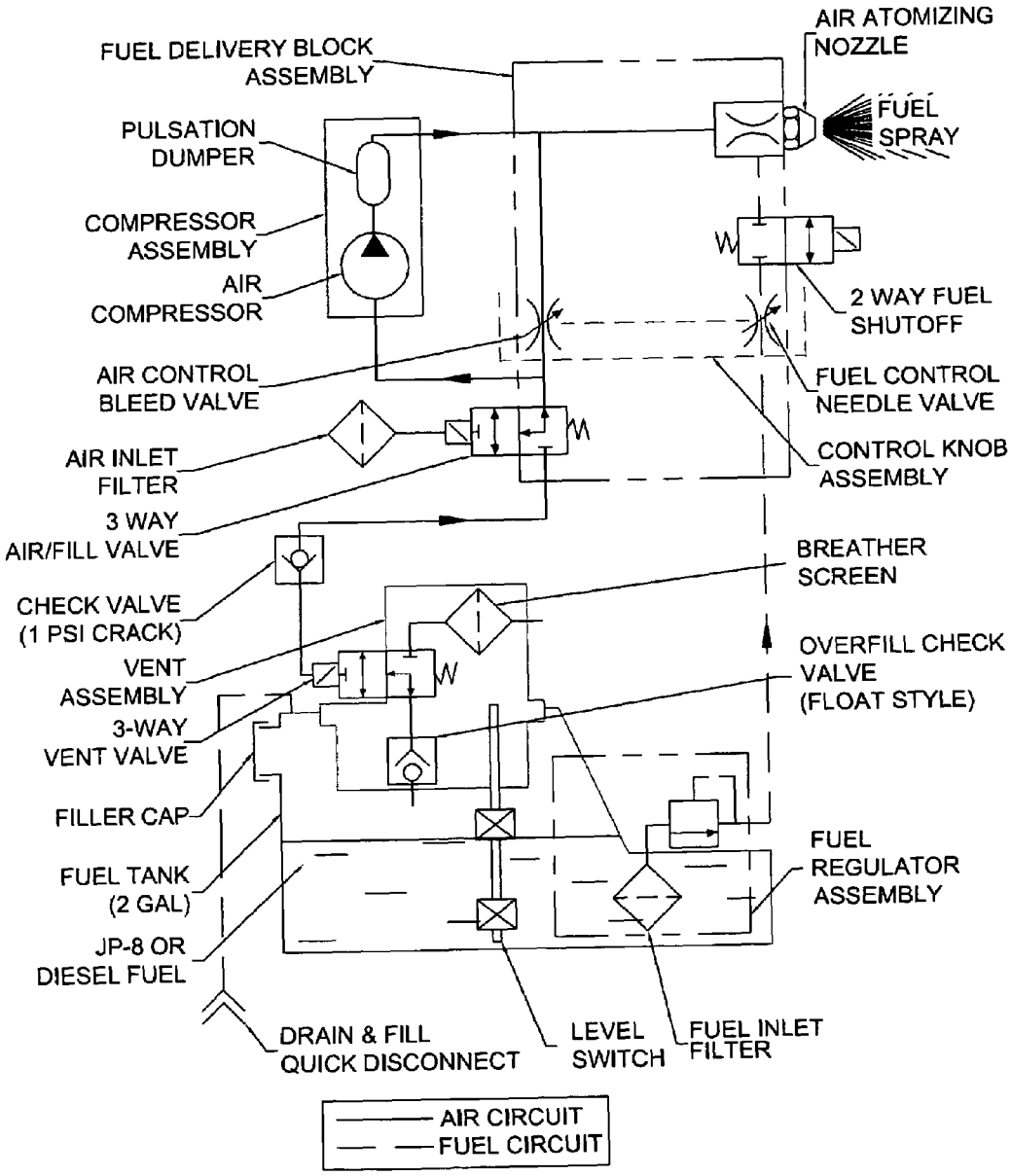
FIG. 14 is a schematic diagram of the air/fuel system thereof.

Referring to FIG. 13, this shows the valve control apparatus 20 operatively connected to the bleed device 54, as indicated by line 136. The passageway 38 has a first portion 132 extending to air conduit 124 between compressor 120 and burner 122. The passageway has a second portion 135 which extends to low-pressure port 137 of the compressor. Thus, as the bleed device progressively opens, more air is bled from high-pressure port 133 of the compressor through the passageway 38 and back to the intake port 137 to reduce the amount of air supplied to the burner 122. The valve 20 is connected to fuel line 140 extending to fuel tank 126. This figure may represent a stove apparatus the same as disclosed in U.S. Pat. No. 6,450,801, apart from the valve control apparatus described above. The disclosure of U.S. Pat. No. 6,450,801 is incorporated herein by reference. Further details of the air/fuel system may be seen in the schematic diagram of FIG. 14.

In operation, the knob 42 is first removed by unthreading the nut 103 shown in FIG. 2*a*. The collet 93 is then removed from the end 90 of the stem 24 so the device resembles that shown in FIG. 3. The fuel line is disconnected and a pressure gauge is attached to measure the air pressure. The valve member 34 is screwed downwardly by rotating the collar 80 clockwise. Initially the air pressure will be zero since the passageway 38, shown in FIG. 1, will be open. Eventually portion 36 of the valve member blocks the passageway and the air pressure starts to rise. Rotation of the valve member is continued until the side 98 of the groove 54 reaches the passageway 38 as seen in FIG. 12. Once the pressure starts dropping, the body is rotated counter clockwise until the passageway 38 is barely closed. The knob 42 is then installed with projection 84 fitted to the closest slot 82 shown in FIG. 3 with the projection 112 against the pin 110. This is the high setting of the burner. The nut 103 and washer 105 shown in FIG. 2*a* are installed and the nut rotated on the threaded shaft 99 of collet 93 to take up the slack, but the nut is not tightened. A screwdriver is used to rotate the needle valve via slot 89 shown in FIG. 2*a*. A flow meter is connected to the device to measure the fuel rate. The fuel rate is adjusted to a desired value for the high setting of the burner, say 2.8 gallons per hour. The nut 103 is then tightened to secure the needle valve in position by tightening the collet 93 about the outer and 90 of the valve stem. The knob may be rotated to the low heat setting and the adjustment repeated.

After the initial setup, the knob is rotated to adjust both the amount of fuel reaching burner 122 along with the amount of air reaching the burner. Typically, when the knob is rotated clockwise, the tip of the needle valve moves closer to the seat to reduce the amount of fuel reaching the burner through the line 140. At some desired point the slot 54 reaches the passageway 38 and begins to bleed air from the high-pressure side of the compressor, back to its low-pressure port 137. The amount of air bled is increased as the fuel supply is reduced to give the burner a proper simmer.

Figure 4:
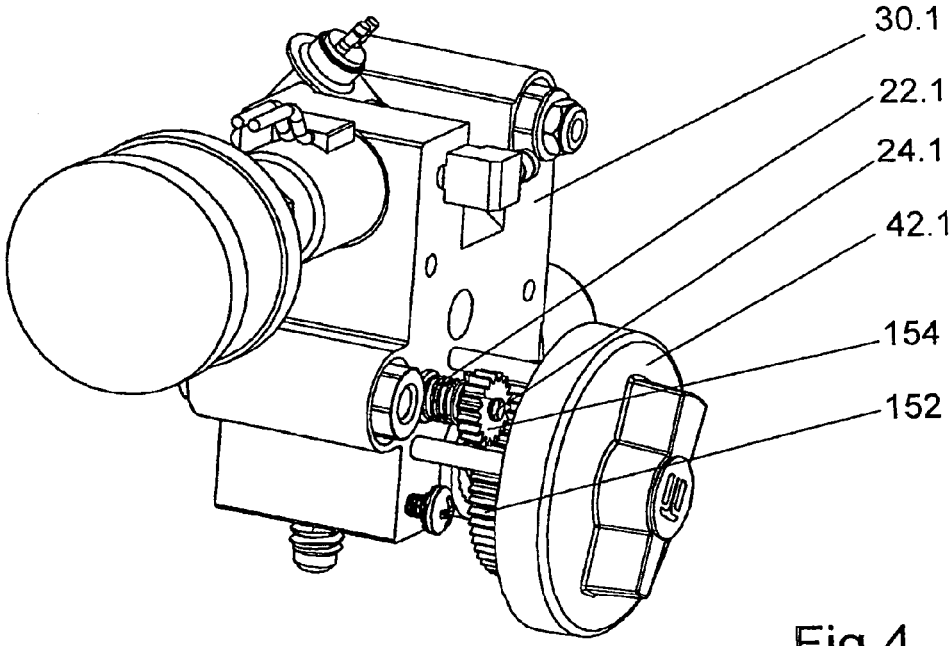
FIG. 4 is an isometric view of an alternative embodiment thereof.
Figure 5:
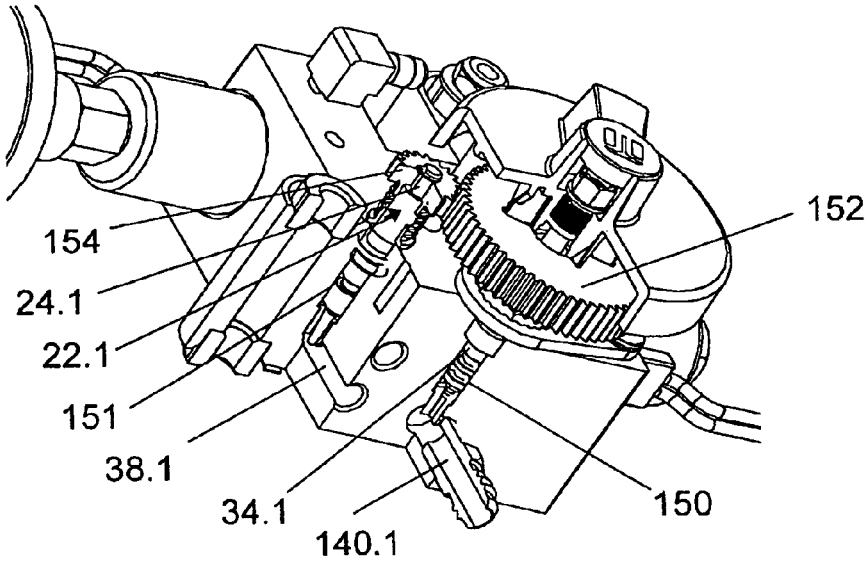
FIG. 5 is another isometric view of the embodiment of FIG. 4, shown partly in ghost and partly broken away.

A second embodiment of the invention is shown in FIGS. 4 and 5. This is generally similar to the first embodiment and accordingly is only described with respect to the differences. Like parts have like numbers with the additional designation "0.1". Control valve 22.1 includes a valve body 30.1 having a valve member 34.1 received within a first cavity 150. Control knob 42.1 is connected to the valve member in a manner similar to the previous embodiment. However needle valve 22.1 is located in a second cavity 151 in the body which is spaced-apart from the first cavity. There is a large gear 152 connected to the knob which engages a smaller gear 154 on shank 24.1 of the needle valve. Thus, when the knob is rotated, it simultaneously can adjust the fuel supply in fuel line 140.1 and bleeding of the air via passageway 38.1. The two needle valves are rotated in opposite directions by the gears. Therefore, in the first instance the fuel supply closes as the air bleed increases. In the opposite directions of rotation, the fuel supply opens as the air bleed decreases.

Figure 6:
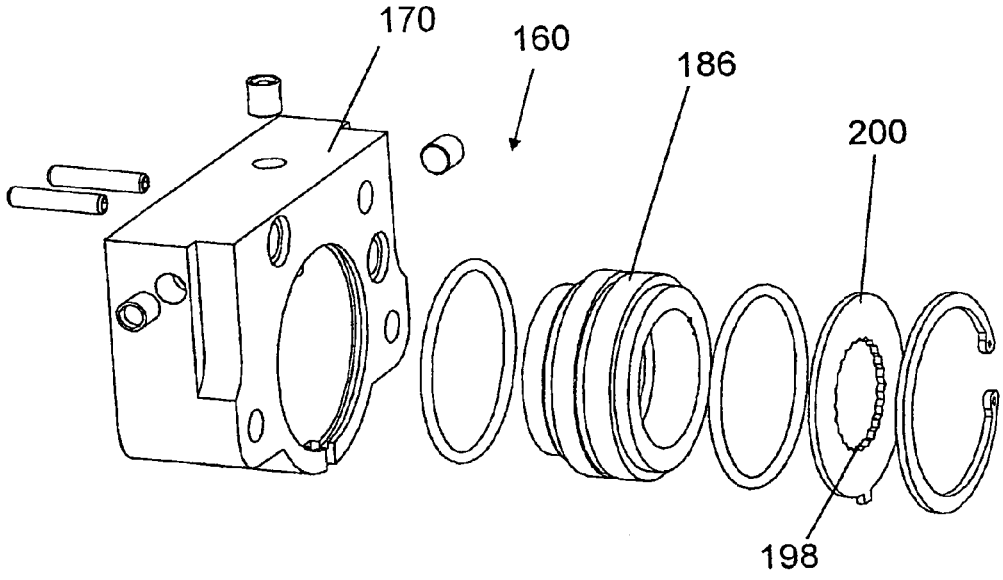
FIG. 6 is an exploded view of a bleed valve according to a third embodiment of the invention.
Figure 7:
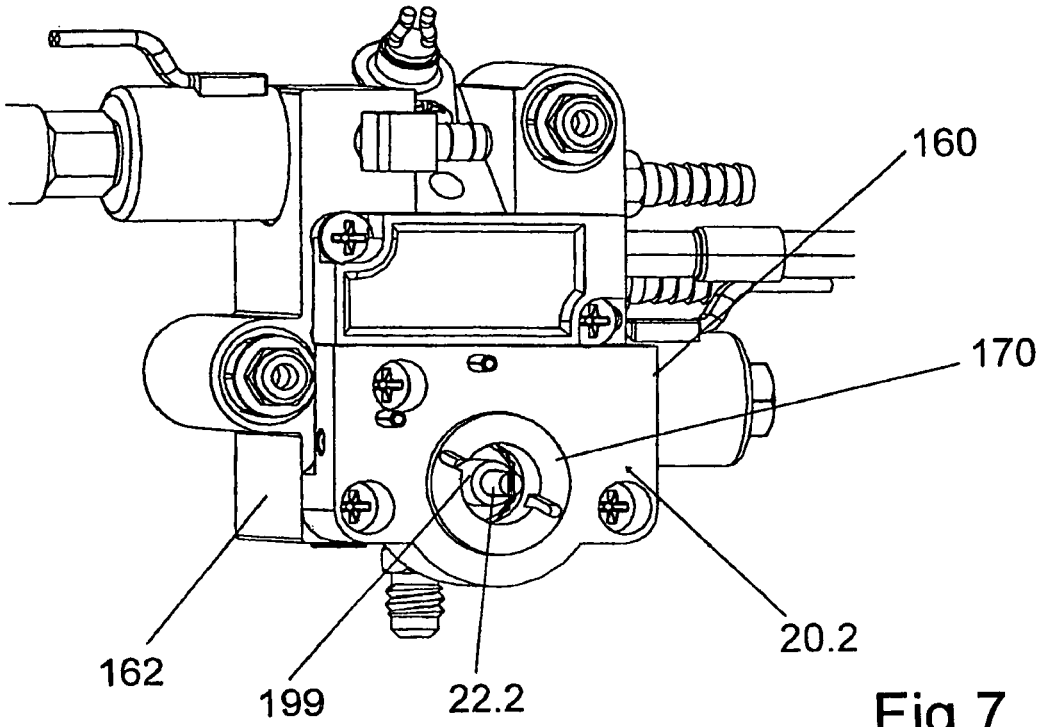
FIG. 7 is an isometric view of the apparatus incorporating the bleed valve shown in FIG. 6 with the control knob thereof removed.
Figure 7A:
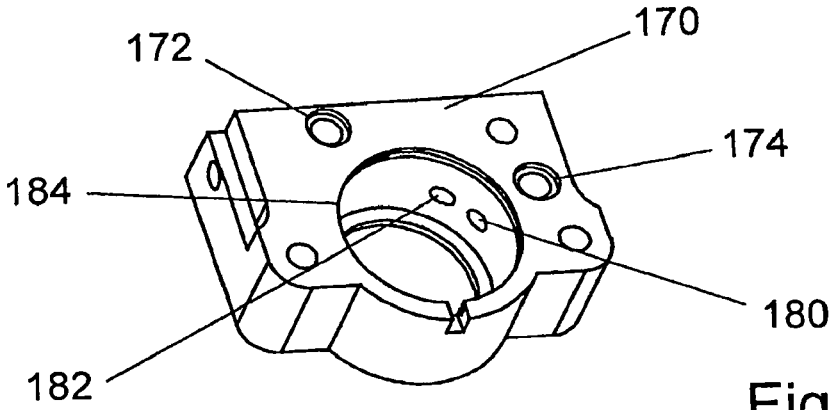
FIG. 7*a* is an isometric view of the housing of the bleed device thereof.
Figure 8:
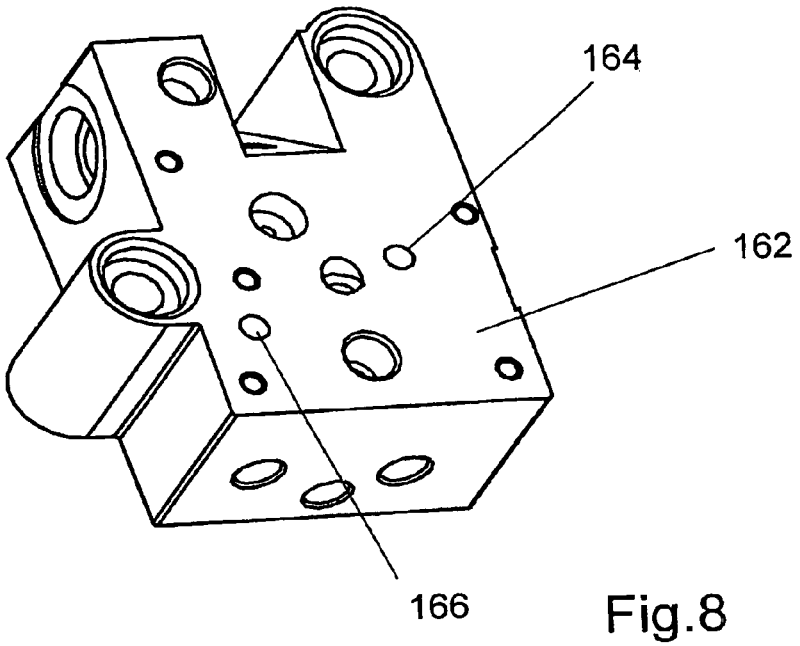
FIG. 8 is an isometric view of the body thereof.
Figure 8A:
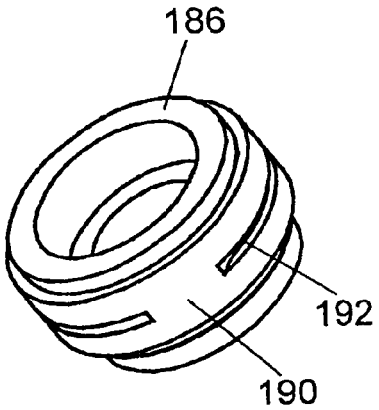
FIG. 8*a* is a bottom, isometric view of the rotor thereof.
Figure 8B:
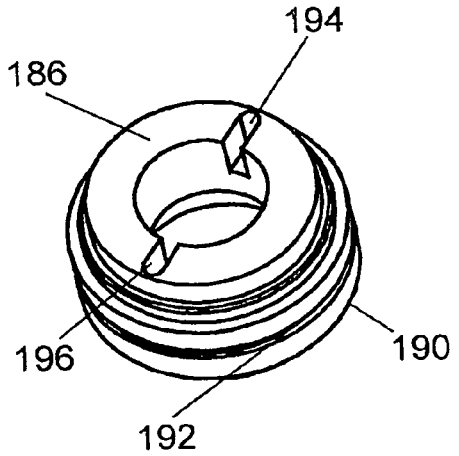
FIG. 8*b* is a top, isometric view thereof.
Figure 9:
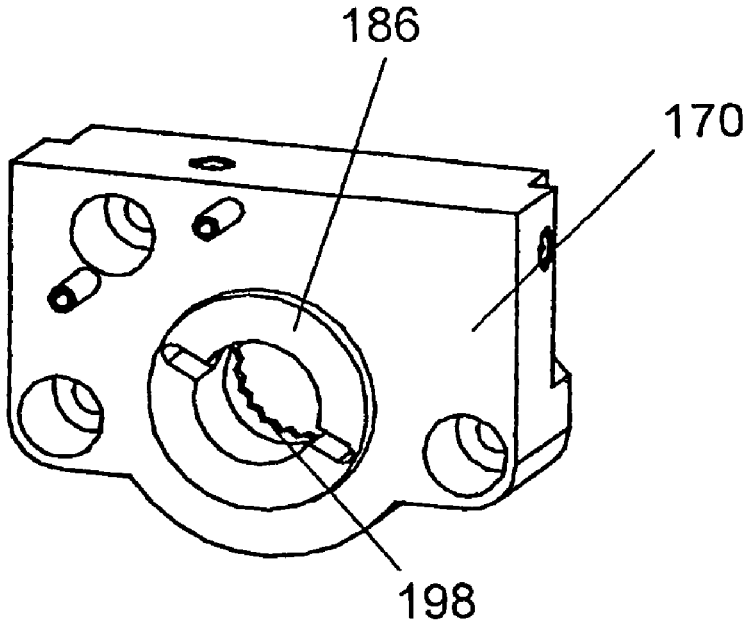
FIG. 9 is a bottom, isometric view of the housing of FIG. 7*a* with air bleed components installed.
Figure 10:
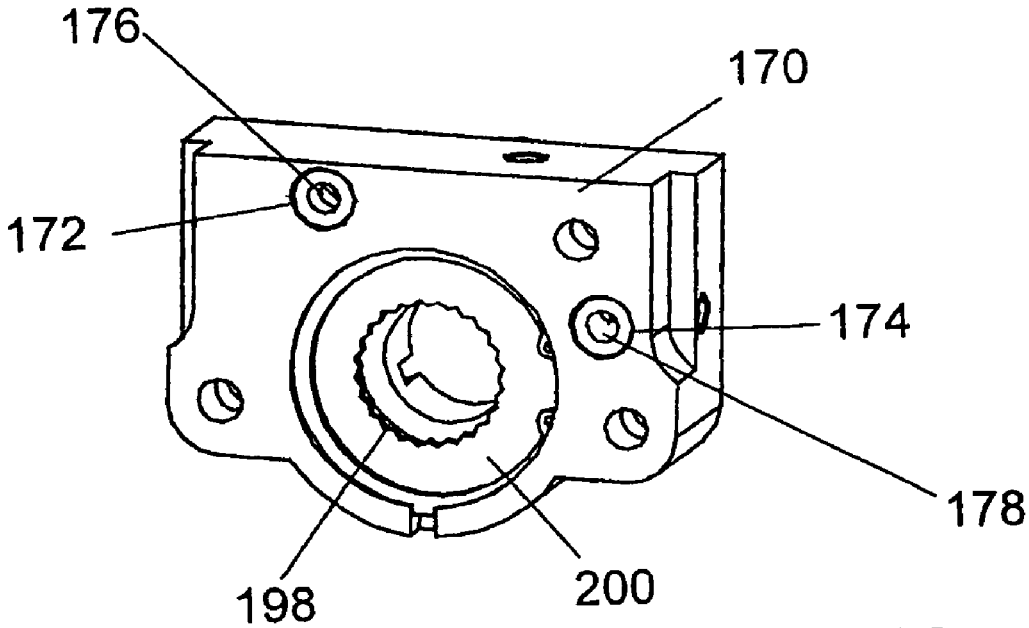
FIG. 10 is a top, isometric view thereof.

A third embodiment of the invention is shown in FIGS. 6–10. In this example like parts have like numbers with the additional designation ".2,". Valve control apparatus 20.2 has a needle valve 22.2 and an external bleed valve 160 which is connected to fuel delivery block 162. The fuel delivery block has two passageways 164 and 166 which are connected to the high-pressure port and low-pressure port respectively. There is a rotary valve body 170 with two corresponding openings 172 and 174, provided with O-rings 176 and 178 respectively as shown in FIG. 10. These openings are connected by internal passageways (not shown) with two openings 180 and 182 communicating with cylindrical inner surface 184. A rotor 186, shown best and FIGS. 8*a* and 8*b*, is rotatably received against the cylindrical inner surface. The rotor has an outer surface 190 with a radial groove 192 with a depth which gradually changes about the rotor. Clearance between the cylindrical inner surface and the outer surface of the rotor provides easy rotation of the rotor inside the valve body 170. The depth of the groove between the two openings 180 and 182 defines the air bleed between the ports. There are two slots 194 and 196 on the rotor which engage the projections on the knob to permit manual turning of the rotor. With reference to FIGS. 6, 9 and 10, there is a notched inner bore 198 on back cover 200 which retains needle valve nut 199 shown in FIG. 7 and prevents it from turning.

It will be understood by someone skilled in the art that many of the details provided above are by way of example only and are not intended to limit the scope of the invention which is to be interpreted with reference to the following claims:

The invention is:

1. A control apparatus for simultaneously controlling flow rates of a first fluid and a second fluid, the first fluid being a liquid and the second fluid being a gas, the apparatus comprising:

a control valve for controlling the flow rate of the first fluid, the control valve being a needle valve;

a bleed device for bleeding the second fluid;

the needle valve being operatively connected to the bleed device by a control member, whereby as the control valve is opened progressively greater amounts to increase flow of the first fluid, the bleed device is progressively closed to decrease bleeding of the second fluid, and, as the control valve is closed progressively greater amounts to decrease flow of the first fluid, the bleed device is progressively opened to increase bleeding of the second fluid; and a valve body having a first cavity therein and a valve member releasably connected to the control member and rotatably received within the first cavity, the bleed device being on the valve member, the first cavity having a female threaded portion which threadedly receives a male threaded portion of the valve member, whereby rotation of the control member moves the valve member axially within the first cavity to open or close the bleed device, the needle valve including a shank having a valve tip, the body having a second cavity, receiving the shank, the second cavity having a female threaded portion which threadedly receives a male threaded portion of the shank, the shank being releasably and operatively connected to the control member, whereby, when the control member is connected to the valve member and operatively connected to the shank, rotation of the control member in a first rotational direction moves the valve tip toward the valve seat to close the needle valve and rotation of the control member in a second rotational direction, opposite the first rotational direction, moves the valve tip away from the valve seat to open the needle valve.

2. The apparatus of claim 1, wherein the body has a passageway for a gas which intersects the first cavity, the valve member having a portion which selectively blocks the passageway or opens the passageway as the control member is rotated.

3. The apparatus of claim 2, wherein the valve member has an opening adjacent to the portion thereof which progressively aligns with the passageway as the needle valve is closed, thereby increasing bleeding of the gas.

4. The apparatus as claimed in claim 3, wherein the opening is a groove on the valve member which moves into alignment with the first passageway as the control member is rotated in a direction which moves the valve tip toward the valve seat.

5. The apparatus as claimed in claim 4, wherein the control member is a knob and is operatively connected to the shank by gears.

* * * * *